United States Patent [19]

Dawes et al.

[11] Patent Number: 4,563,223

[45] Date of Patent: Jan. 7, 1986

[54] CORROSION RESISTANT STEEL COMPONENTS AND METHOD OF MANUFACTURE THEREOF

[75] Inventors: Cyril Dawes, Sutton Coldfield; John D. Smith; Colin G. Smith, both of Solihull, all of England

[73] Assignee: Lucas Industries, Birmingham, England

[21] Appl. No.: 596,930

[22] Filed: Apr. 5, 1984

[30] Foreign Application Priority Data

Apr. 14, 1983 [GB] United Kingdom ..... 8310102

[51] Int. Cl.[4] ..... C23C 11/16

[52] U.S. Cl. ..... 148/16.5; 148/16.6; 148/203; 148/143; 148/144; 148/148; 148/152

[58] Field of Search ..... 148/16.5, 16.6, 20.3, 148/143, 144, 148, 152

[56] References Cited

U.S. PATENT DOCUMENTS 4,406,714 9/1983 Bowes et al. ..... 148/16.6

FOREIGN PATENT DOCUMENTS 2715745 10/1977 Fed. Rep. of Germany .
56-58963 4/1981 Japan .
55-125267 12/1981 Japan .
57-9869 5/1982 Japan .
338315 11/1930 United Kingdom .
463511 4/1937 United Kingdom ..... 148/6
522252 6/1948 United Kingdom .
784062 10/1957 United Kingdom .
1522447 8/1978 United Kingdom .

OTHER PUBLICATIONS

Nitrotec Surface Treatment, Dawes & Tranter, Heat Treatment of Metals, No. 4, 1982, pp. 85–90.

Coates, et al, "The Oxidation and Corrosion Resistance of Nitrited Iron Alloys", Corrosion Science, 1982, 22(10) 951–72.

Nitrotec Surface Treatment, Lucas Publication 4134/A, Sep. 1982; 4163, 4/29/83.

*Primary Examiner*—Veronica O'Keefe

*Attorney, Agent, or Firm*—Ladas & Parry

[57] ABSTRACT

To impart good salt spray corrosion resistance to alloy steel components, such components are gas nitrocarburized at 550° C. to 800° C. to produce an epsilon layer, oxidized to produce an $Fe_3O_4$ layer not more than 1 micrometer thick, quenched into an oil/water emulsion, degreased and then wax coated. The steel components may be surface finished after nitrocarburizing.

A carburizing, carbonitriding or neutral atmosphere heat treatment may be effected prior to nitrocarburizing heat treatment with both heat treatments being effected at above the pearlite to austenite transformation temperature.

28 Claims, 5 Drawing Figures

CORROSION RESISTANT STEEL COMPONENTS AND METHOD OF MANUFACTURE THEREOF

This invention relates to corrosion resistant steel components and to a method of manufacture thereof and is concerned with modifications to the techniques described in our No. EP-A-0077627.

In the above-mentioned No. EP-A-0077627, there are described techniques for the treatment of non-alloy steel components in order to impart corrosion resistant properties thereto. We have now found that such techniques are applicable to alloy steels, particularly low alloy steels.

According to one aspect of the present invention, there is provided a method of manufacturing a corrosion resistant alloy steel component comprising the steps of heat treating a alloy steel component in a gaseous atmosphere to produce an epsilon iron nitride or carbonitride surface layer thereon, subsequently heat treating the component in an oxidizing atmosphere to provide an oxide-rich surface layer consisting mainly of $Fe_3O_4$, said layer having a thickness which, in the finished component, does not exceed 1 micrometer, and then cooling the component.

With regard to the step of heat treating the component in a gaseous atmosphere to form the epsilon iron nitride or carbonitride surface layer, this step is typically effected at a temperature in the range of 550° to 800° C. for up to 4 hours in a nitrocarburizing atmosphere of, for example, ammonia, ammonia and endothermic gas, ammonia and exothermic gas or ammonia and nitrogen, with the optional inclusion of at least one of carbon dioxide, carbon monoxide, air, water vapour and methane. The terms "exothermic gas" and "endothermic gas" are well understood in the art.

Carbon dioxide, carbon monoxide, air, water vapour and exothermic gas are catalytic gases added to ammonia for nitrocarburising. They do not form oxides during nitrocarburising. Carbon monoxide, methane and endothermic gas are carburizing gases. It is preferred to effect the heat treatment operation so that the epsilon iron nitride or carbonitride surface layer has a thickness of about 25 micrometers. However, thicknesses up to about 75 micrometers may be used with attendant processing time penalties (up to about 4 hours or more). Typically, a layer thickness of about 25 micrometers can be obtained by heat treatment at 660° C. for 45 minutes. Such a layer thickness may also be produced by heat treatment of 570° C. for 3 hours or at 610° C. for 90 minutes. However, the heat treatment temperatures and times may be employed to produce layer thicknesses less than 25 micrometers, e.g. down to 15 micrometers. For example, heat treatment of 570° C. for 2 hours can be employed to produce a layer thickness of 16 to 20 micrometers. For low carbon and some medium carbon alloy steels the temperature of heat treatment is typically 550° C. to 720° C., preferably 610° C. to 660° C.

In the case of components where good engineering properties are required, depending upon the alloy, it may be necessary to perform the oxidation step before the temperature falls below 550° C. and then to quench so as to retain nitrogen in solid solution in the matrix of the steel thereby to retain the fatigue and yield strength properties.

Where particularly high core properties are required (in excess of 70 tonf/in$^2$ (1080 MPa), these can be achieved using a medium carbon (typically 0.3–0.5% C) starting material, e.g., BS970 817M40 (formerly En24) low alloy steel or BS970 080 A37 (formerly En8) non-alloy carbon-manganese steel. The gaseous heat treatment is then carried out at a temperature above the pearlite to austenite tranformation temperature of the particular steel. This is usually about 720° C. although for some steels it may be as low as 700° C. A temperature up to 800° C. is preferred. Oxidation and quenching procedures would then be implemented.

Typically, the oxidation step is effected for at least two seconds by exposing the component to air or other oxidising atmosphere before quenching to arrest oxidation. In this aspect of the invention, oxidation is limited so that the depth of oxide penetration into the component does not exceed one micrometer. Oxidation penetration to greater depths can lead to oxide exfoliation in service. It is, however, preferred to ensure that oxygen penetration into the component is to a depth of at least 0.2 micrometer, i.e. that the thickness of the oxide layer is at least 0.2 micrometer, but preferably does not exceed 1 micrometer. More preferably, the oxide layer has a thickness of 0.2 to 0.7 micrometer, most preferably 0.5 micrometer. One way of controlling depth of oxygen penetration is to limit the exposure time of the component to the oxidising atmosphere. In the case where oxidation is effected by exposure to air, the exposure time typically does not exceed 60 seconds. Preferably, the exposure time of the component is 2 to 20 seconds. If the oxidising atmosphere to which the component is exposed is at the ambient temperature of heat treatment furnace surroundings (i.e. about 30° C.), then the component may cool to a temperature below 550° C. in a relatively short time. This is a factor which must be taken into consideration where good engineering properties are required of the component since it is important with many alloys to ensure that nitrogen is retained in the matrix of the steel microstructure by quenching before the temperature falls below 550° C. However, certain alloy steels retain good engineering properties without such quenching techniques.

Cooling is effected preferably by quenching into an oil/water emulsion. In the case of components which have been oxidised and then quenched into an oil/water emulsion, an aesthetically pleasing black finish is obtained. Quenching the component directly into an oil/water emulsion without the intermediate oxidation step does not give a black finish but a grey finish where the oxide layer is only 0.1 micrometer thick. However, quenching an already oxidised component into the oil/water emulsion does increase the degree of oxidation to a small extent and thereby darkens the colour.

During quenching in the oil/water emulsion, an atmosphere of steam is produced as a small pocket around the component within the emulsion to give a controlled cooling rate. This will give a distortion-free component with maximum properties. Quenching into the oil/water emulsion after oxidation produces a black surface with extremely good corrosion resistance (up to 90 hours) and, by virtue of the residual oily film, improved bearing properties, if these are required. An oil-free or dry surface finish with a salt spray corrosion resistance up to 240 hours can be obtained by vapour degreasing the as-quenched component and then treating it with a hard film solvent-deposited corrosion preventive material, e.g. a hard waxy composition. This treatment by either dipping or spraying can be effected at room temperature and can still give improved bearing properties, if such are required. In a particular embodiment, a steel component, after having had an epsilon iron nitride or carbonitride surface layer formed thereon by heat treatment at 570° C. for about 2 hours in an atmosphere 50% ammonia and 50% endothermic gas mixture is exposed to ambient air for two seconds to effect surface oxidation and then immediately immersed in a bath of an oil-in-water emulsion which, in this embodiment, is produced by mixing a soluble oil sold under the trade mark CASTROL V553 with water in an oil:water volume ratio of 1:10. The resultant product has a good fatigue strength and yield strength in addition to having an aesthetically pleasing black surface with extremely good resistance to corrosion and good bearing properties in view of the absorption of oil into the surface. An oil-free or dry surface finish can be obtained by vapour degreasing the quenched component and then treating it with a hard (i.e. tack-free film), solvent-deposited corrosion preventative waxy composition (e.g. CASTROL V425). Such a waxy composition contains waxy aliphatic and branched chain hydrocarbons and Group 2a metal soaps, preferably calcium and/or barium soaps. The amount of wax coating on the component is preferably up to 7 $g/m^2$ of component surface. At coating weights greater than 7 $g/m^2$, the coated component tends to become tacky, whereas a tack-free finish is advantageous for ease of processing and handling. For good corrosion resistance, the wax coating weight is preferably a minimum of 2 $g/m^2$.

The oxidation step is usually effected immediately after the heat treatment of the component in the gaseous atmosphere, i.e. befofe it has cooled. However, it is within the scope of the present invention to effect the oxidation step at a later stage. Thus, after the component has been heat treated in the gaseous atmosphere, it can be cooled by any desired method in a non-oxidising atmosphere and then subsequently re-heated in a non-oxidising atmosphere and then subjected to air or other oxidising atmosphere at 300° to 600° C. for a suitable period of time to provide the required oxide layer. The treatment time will depend upon the temperature, the lower the temperature, the longer the treatment time. For a treatment temperature range of 300° to 600° C., the typical time range will be 30 minutes to 2 minutes. Following re-heating, the component may then be quenched or fast cooled in air. Following this, the component may be coated with a waxy composition in the manner described hereinabove, after degreasing if necessary.

In the case where the component is required to have a fine surface finish without the need to have a waxy protection system to give a good corrosion resistance, the component may, after being heat treated in the gaseous atmosphere, be cooled in any desired medium, and then subjected to a lapping or other mechanical surface finishing process to a surface roughness of, for example, not more than 0.2 micrometers Ra. This lapping or polishing process will remove any oxide film which may have formed on the component, depending upon the medium used for cooling. After the lapping or polishing process, the component can then be oxidised at a temperature of 300° to 600° C. The actual temperature depends upon the appearance required of the steel component and, more importantly, upon the properties thereof. If the component is a one which is not required to have very high fatigue properties (e.g. as a damper rod), then the oxidising heat treatment is preferably effected at 350° to 450° C. for about 15 to 5 minutes depending upon the temperature in unstripped exothermic gas. However, for good fatigue properties, the component is preferably heat treated at 500° to 600° C., more preferably, 550° to 600° C. followed by quenching. Instead of using unstripped exothermic gas, another type of oxidising atmosphere may be employed such as steam, air or other mixture of oxygen and nitrogen carbon dioxide and nitrogen, or carbon dioxide alone or any mixture of these gases. It is possible to use these oxidising atmospheres in the previously described processes not involving lapping or polishing, as an alternative to air.

Alloy steel components produced according to the present invention have a hard wear resistant layer and a surface having an extremely good resistance to humidity and salt spray corrosion. Such components also have a low coefficient of friction (similar to polished hard chromium plating) so that they are capable of being used in sliding applications. Further, such components possess a high surface tension which gives extremely low wettability which is of great help in a resisting humidity and salt spray corrosion attack and also have a pleasing aesthetic appearance (gloss blue/black according to the temperature employed in the oxidising treatment). Additionally, steel components which have been quenched from 550° C. and above to keep nitrogen in solid solution also have good fatigue and yield strength properties.

The method of the invention can be performed by processors with modern gaseous atmosphere heat treatment plant without the requirement for further capital investment in plating or salt bath equipment.

We have found by Auger Spectroscopy that the mechanism of oxygen introduction upon oxidation in the gaseous state in accordance with the invention is by way of displacement of nitrogen not merely by way of absorption of oxygen.

The fact that the mechanism of oxygen introduction upon oxidation is by way of displacement of nitrogen rather than merely by absorption of oxygen is surprising because the resultant component has a surface finish which is visually similar to the surface finish of the known salt bath heat treated and oxidised component discussed previously. Such a salt bath heat treated and oxidised component is disclosed in "A New Approach to Salt Bath Nitrocarburising" by I. V. Etchells (Heat Treatment of Metals, 1981.4, pages 85–88) as having high contents of both oxygen and nitrogen in the component down to a depth of some 2.5 micrometers from the surface of the component. Below this, the oxygen content falls rapidly whilst the nitrogen content only falls relatively slowly. It would therefore be reasonable to have concluded that a similar structure is obtained by the process of the present invention. However, this is not the case as noted above.

In a preferred example of the invention, the surface layer portion is substantially free of nitrogen atoms.

Preferably, the surface layer portion wherein substantially all of the nitrogen atoms have been displaced by oxygen atoms extends for a depth of at least 0.2, more preferably at least 0.3, micrometer.

The resistance of the oxidised surface to corrosion is explained by the predominance of iron oxide, mainly in the form of $Fe_3O_4$ down to a depth of at least 0.1 micrometer and sometimes down to more than 1 micrometer in depth. However, to avoid oxide exfoliation, it is preferred for iron oxide to be present down to a depth not exceeding 1 micrometer.

Displacement of nitrogen is total in the outermost surface layers portions (i.e. down to a depth which may vary between 0.1 micrometer and 1 micrometer,) depending upon the time of exposure to air while the sample is hot before quenching, and also on the cooling rate in the quench. Partial displacement of the nitrogen continues in some instances in excess of 1 micrometer to the depth of the microporous epsilon layer.

This is in direct contrast to the reported effects obtained by salt bath oxidation following salt bath nitriding where oxygen is reported as being simply absorbed into the nitride lattice.

The present invention is applicable to alloy steels which are required to have similar property improvements to those obtained for non-alloy steels by following the teachings of No. EP-A-0077627. However, alloy steels show greater hardnesses than mild steel (non-alloy steel) in the nitrogen diffusion zone and do not necessarily need to be fast cooled to maintain a good hardness profile. Thus, excellent support for the oxidised epsilon iron nitride or carbonitride layer is provided by an alloy steel.

For the purposes of the present invention, alloy steels can be divided broadly into two categories:

(1) Alloy steels containing nitride forming elements such as chromium, molybdenum, boron and aluminium, and (2) Alloy steels which are normally hardened and then tempered at 550° C. to 650° C. Such steels maintain their core properties after the nitrocarburizing process.

Figure 1:
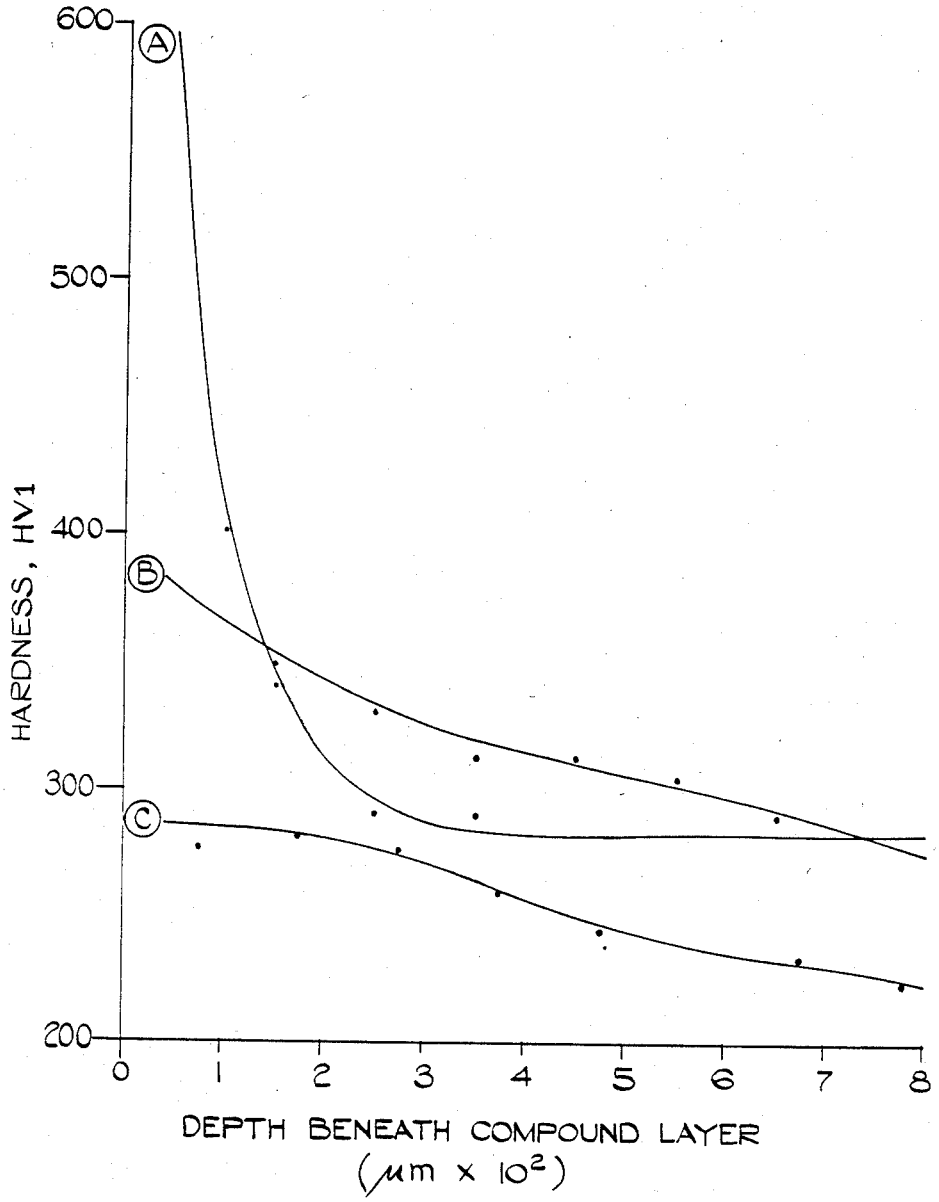
FIG. 1 shows the support hardness profiles for various steel types. Hardness is plotted against the depth of the case hardened layer below the epsilon layer.

These categories are not mutually exclusive. For steels in category (1), the oxidised epsilon iron nitride or carbonitride layer receives excellent support from the very hard, nitrogen-rich diffusion zone as will be apparent from FIG. 1 which is a graph in which hardness (HV1) is plotted against the depth of the case hardened layer below the epsilon layer. In FIG. 1, curve (A) was obtained from a sample of an alloy steel rod according to BS970 709M40 (formerly En 19) which had been nitrocarburized for 1½ hours at 610° C. in a 50 vol % ammonia/50 vol % endothermic gas mixture followed by fast quenching into an oil-in-water emulsion. The alloy steel of the above sample falls into category (1) above but not category (2).

Alloy steels in category (2) above but which do not fall into category (1) typically show the type of hardness profile indicated by curve (B) in FIG. 1.

Curve (B) was obtained from a sample of an alloy steel rod according to BS 970 605M36 (formerly En 16) which had been nitrocarburised and quenched in the same manner as for the sample for curve (A).

For comparison, curve (C) was obtained from a sample of a mild steel (non-alloy steel) rod nitrocarburized and quenched as described above for the sample of curve (A).

With alloy steel components additionally requiring (i) very substantial support hardness profiles allied with (ii) high core hardnesses, a further aspect of the present invention resides in a duplex heat treatment stage prior to the oxidation procedures used to confer enhanced corrosion resistance on the component.

To achieve the high core hardnesses mentioned above (i.e., in excess of 1080 MPa) medium carbon non-alloy and/or low-alloy steels must be used (i.e., 0.3–0.5% carbon). The process then involves carburising or carbonitriding using a gaseous atmosphere at 750°–1100° C. to provide a deep carbon rich zone at the surface followed by nitrocarburising in a gaseous atmosphere at a temperature in the range 700°–800° C. (i.e., above the pearlite to austenite transformation temperature ($Ac_1$) for the particular steel concerned) to form an epsilon iron carbonitride layer on top of the carbon rich zone. Quenching from this temperature produces a duplex core structure of ferrite and martensite with excellent mechanical properties and a hardened martensitic case beneath the epsilon iron carbonitride compound layer.

If bulk core strength is not of great importance, the above described process route can be readily applied to low carbon non-alloy steels such as BS970 045M10 (formerly En32).

In the first stage of the duplex heat treatment, the gaseous atmosphere employed may be exothermic gas, endothermic gas or a synthetic carburizing atmosphere, enriched with hydrocarbon to a suitable carbon potential (e.g. 0.8% C).

In another duplex heat treatment, the first heat treatment step is effected under the same temperature conditions as the carburising or carbonitriding step but under a neutral atmosphere i.e. an atmosphere which does not affect the carbon content of the steel. This is most conveniently done by matching the carbon content of the atmosphere with that of the steel. This form of duplex heat treatment is mainly applicable to medium and high carbon steels. The second heat treatment step is effected so as to produce an epsilon iron nitride or an epsilon iron carbonitride layer.

The second heat treatment step is usually effected at a lower temperature than the first heat treatment step. Cooling of the component between the first and second heat treatment steps may be effected in any of the following ways:

(i) Cooling to ambient temperature whilst avoiding exposure to severe oxidising conditions and subsequently reheating to the nitrocarburizing temperature. The cooling may be effected (a) by oil quenching followed by degreasing, (b) by synthetic quench followed by washing and drying, or (c) by slow cooling under a protective atmosphere.

(ii) Transferring the component from one furnace zone at the first stage heat treatment temperature to another furnace zone at the nitrocarburizing temperature either directly or through one or more intermediate zones.

(iii) Cooling the component in the same furnace zone used for the first stage heat treatment until it reaches the nitrocarburizing temperature.

The nitrocarburizing step may be effected for up to 4 hours depending upon the temperature and the required depth of the epsilon iron nitride or carbonitride layer. The atmosphere employed may be ammonia, ammonia + endothermic gas, ammonia + exothermic gas or ammonia + nitrogen + $CO_2$/$CH_4$/air.

After either of the aforesaid duplex heat treatments, the component may or may not be subjected to an oxidation step before quenching, depending on the subsequent process route.

Quenching is necessary in this aspect of the invention in order to achieve the core and case properties required.

In engineering applications where the component is oxidised prior to quenching, the oxidation may be effected in lean exothermic gas, steam, nitrogen and steam, carbon dioxide, nitrogen and carbon dioxide, nitrogen/oxygen mixtures or in air so as to produce the required oxide rich layer as discussed hereinabove. Quenching after the oxidation step is preferably effected by use of an oil/water emulsion.

If oxidation is not necessary at this stage because the component is to be subjected to further processing, e.g. polishing, prior to a post-oxidising treatment, then oxidation may be prevented by quenching the component under the protection of the nitrocarburising atmosphere or some other protective atmosphere such as nitrogen, endothermic gas, or rich exothermic gas. Quenching under a protective atmosphere may be accomplished using any suitably fast medium, but most usually using oil.

After quenching, the component is washed and dried, or degreased as necessary.

After quenching and cleaning, the component may be dip or spray coated with a wax film to produce a final product or, if required, polished to a fine surface finish followed by a post-oxidation treatment at 300°-600° C. for 2 to 30 minutes in a suitable oxidising atmosphere such an unstripped exothermic gas, exothermic gas+up to 1 vol % $SO_2$, steam, nitrogen+steam, carbon dioxide, nitrogen+carbon dioxide, nitrogen+oxygen mixture, or air.

After post-oxidation, the component may be fast cooled by quenching in an oil/water emulsion, oil, water or a synthetic quench before being washed and dried, or degreased, as necessary. Alternatively, the component may be slow cooled in air or under the atmosphere used in the post-oxidation. The cooled component may then be utilised without any further treatment or it may be dip or spray coated with wax.

Figure 2:
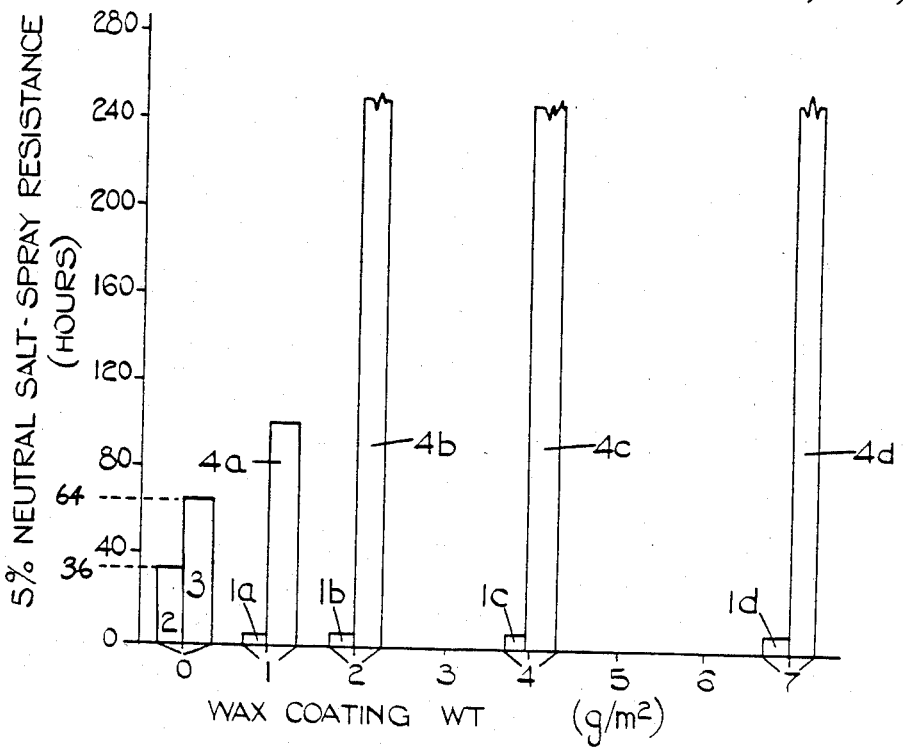
FIG. 2 compares the salt spray resistance achieved by various treatments of low alloy steel.

Referring now to FIG. 2, the blocks illustrated therein relate to the following:

| | |
|---|---|
| Blocks 1a, 1b, - 1c and 1d | results obtained by dipping an untreated low alloy steel component to give specified wax coating weight, |
| Block 2 - | result obtained by nitrocarburizing a low alloy steel component followed by quenching in oil without oxidation by exposure to air, followed by degreasing (grey finish). |
| Block 3 - | result obtained by nitrocarburizing a low alloy steel component followed by oxidation in air and then quenching in an oil/water emulsion, followed by degreasing. (black finish) |
| Blocks 4a, 4b - 4c and 4d | results obtained by degreasing the black component of block 3 above and then dipping to give the specified wax coating weight |

In the above, oxidation in air was effected for 10 seconds.

The waxy coating composition employed comprised a mixture of waxy aliphatic and branched chain hydrocarbons, calcium soaps of oxidized petrolatum and calcium resinate to produce a wax of the requisite hardness at room temperature. The waxy material was contained in a mixture of liquid petroleum hydrocarbons consisting of white spirits and $C_9$ and $C_{10}$ aromatics.

The following specific waxy compositions were employed:

For blocks 1*a* and 4*a:*
Castrol V409 containing 7.5 wt % wax.
For blocks 1*b* and 4*b:*
Castrol V407 containing 10 wt % wax.
For blocks 1*c* and 4*c:*
Castrol V425 containing 15 wt % wax.
For blocks 1*d* and 4*d:*
Castrol V428 containing 30 wt % wax.

Figure 3:
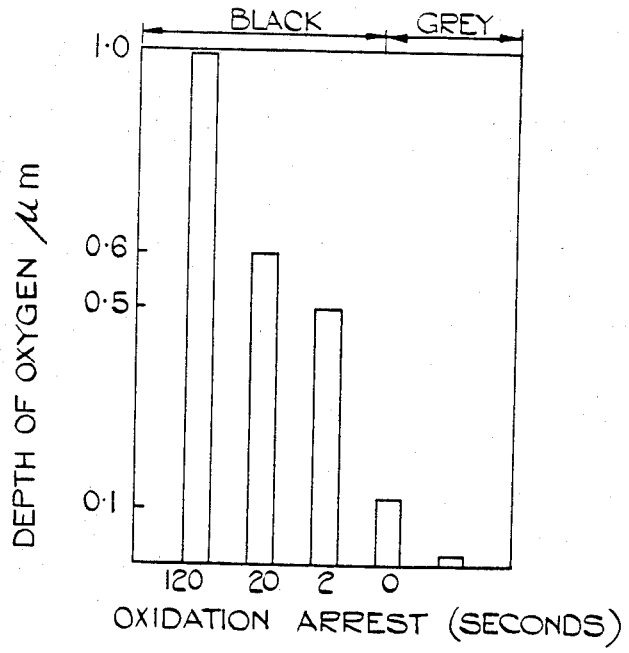
FIG. 3 compares the depth of oxide penetration into the component as a function of oxidation exposure time.

With reference to FIG. 3 the first four blocks relate to exposure of nitrocarburized component at above 550° C. to air for the specified time, followed by quenching in a water/oil emulsion. The last block relates to quenching of a nitrocarburized component directly into oil without exposure to air.

It will be noted in FIG. 2 that the salt-spray resistance times for blocks 4*b*, 4*c* and 4*d* are depicted as of indefinite duration. In fact the tests on these blocks were stopped after 250 hours when the salt-spray resistance was found not to have deteriorated.

Steel components produced according to the present invention have a corrosion resistance which is superior even to components surface treated to produce an epsilon iron nitride surface layer, oil quenched, degreased (or slow cooled under a protective atmosphere) and then dipped in a de-watering oil so that the de-watering oil is absorbed into an absorbent outer portion of the epsilon iron nitride surface layer. Table 1 below compares the corrosion resistant properties of various types of steel component:

TABLE 1

| SAMPLE NO. | SALT SPRAY RESISTANCE (HOURS) |
|---|---|
| 1 | less than 4 |
| 2 | 48 |
| 3 | 120 |
| 4 | 150+ |
| 5 | 250+ |

The salt spray resistance was evaluated in a salt spray test in accordance with ASTM Standard B117-73 in which the component is exposed in a salt spray chamber maintained at 95°+2°-3° F. to a salt spray prepared by dissolving 5+/−1 parts by weight of salt in 95 parts of distilled water and adjusting the pH of the solution such that, when atomised at 95° F., the collected solution has a pH in range of 6.5 to 7.2. After removal from the salt spray test, the components are washed under running water, dried and the incidence of red rusting is assessed. Components exhibiting any red rusting are deemed to have failed.

In the above Table 1, the samples are identified as follows:

Sample 1=a plain, i.e. untreated, low alloy steel component [12.5 mm diameter rods of BS970 709M40 material (formerly En19)].

Sample 2=a similar low alloy steel component having an epsilon iron nitride surface layer produced by the first gaseous heat treatment process in the method of the invention, followed by oil quenching and degreasing (or slow cooling under a protective atmosphere).

Sample 3=the steel component of Sample 2 additionally dipped in a de-watering oil.

Sample 4=a low alloy steel component having an epsilon iron nitride layer and an oxide-rich surface layer according to the present invention produced after lapping the surface to a finish of 0.2 micrometers.

Sample 5=a low alloy steel component having an epsilon iron nitride layer and an oxide-rich layer according to the present invention plus dipping in wax formulation V425 containing 15% wax.

It is to be noted that, in the case of Sample 4, the actual salt spray resistance figure depends upon the surface finish. In a particular example, the steel component treated is a shock absorber piston rod with a final surface finish of 0.13 to 0.15 micrometers Ra. Such a component was found to have a salt spray resistance of 250 hours.

In a modification of the post oxidising procedure, a rod sample was oxidised for 15 minutes at 400° C. in the exothermic gas mixture, but during the last 5 minutes of the 15 minute cycle, sulphur dioxide was introduced into the furnace in an amount such as to give a concentration of 0.25% by volume in the furnace atmosphere. Such a technique caused about 1% of the iron oxide ($Fe_3O_4$) on the surface of the rod to be converted to iron sulphide which gave an aesthetically pleasing shiny black surface to the rod.

The technique of sulphiding is not restricted to components in the form of damper rods and can be used in respect of any components on which it is desirable to have a black hard-wearing surface. With surface finishes greater than 0.25 micrometers Ra, it will be necessary to wax coat in order to produce the desired corrosion resistance. To effect sulphiding, the $SO_2$ content in the oxidizing furnace may be up to 1% by volume and the temperature may be in the range of 300° C. to 600° C. The $SO_2$ will normally be added to the furnace at some stage after the oxidising heat treatment has started in order to convert some of the already formed iron oxide to iron sulphide.

A further variant of the post-oxidising process route for damper rod type applications involves immersing a preheated polished rod for a relatively short time in an agitated aqueous alkaline salt bath operated at relatively low temperatures.

The solution used in the bath is made up using either one or more strong alkalis alone, e.g. sodium hydroxide, or combinations of strong alkalis with compatible nitrites, nitrates and carbonates in concentrations up to 1000 g/l. The solution is operated normally in the range 100°–150° C. This temperature does not cause significant nitrogen precipitation from solid solution, thereby retaining the as-quenched fatigue and strength fatigue and strength property improvements.

The immersion time may be up to 60 minutes. Rods treated by this route have an excellent glossy black appearance and have given up to 250 hrs. salt spray life in the degreased condition. This route has a significant advantage over both a conventional fused AB1 salt bath route and a gaseous oxidation route in that the as-quenched fatigue and strength properties are preserved whereas the high temperature of the other two treatments degrade these properties achieved by quenching from the nitrocarburising stage.

In addition, the aqueous salt bath route minimises effluent problems compared with the fused AB1 salt route.

The following Examples illustrate certain aspects of the present invention in further detail.

EXAMPLE 1

In a specific example of the invention as applied to an alloy steel component, a tappet screw, as used in a commercial vehicle braking system and manufactured from BS 970 709M40 material (formerly En 19T) or BS 970 605M36 material (formerly En 16T), was nitrocarburized for 1½ hours at 610° C. in a 50 vol % ammonia/50 vol % endothermic gas mixture followed by a controlled oxidation arrest in air for 20 seconds, and then quenching into an oil-in-water emulsion produced in this example, by mixing a soluble oil sold by Castrol Ltd under the identification code V553, with water in the ratio of 1:10. (see hardness profile curves (A) and (B), FIG. 1). An oil-free dry surface was then achieved by vapour degreasing the quenched component and applying a tack-free solvent deposited corrosion preventative wax (e.g. Castrol V425) to provide a corrosion resistant surface capable of 240 hours neutral salt spray life.

EXAMPLE 2

Figure 4:
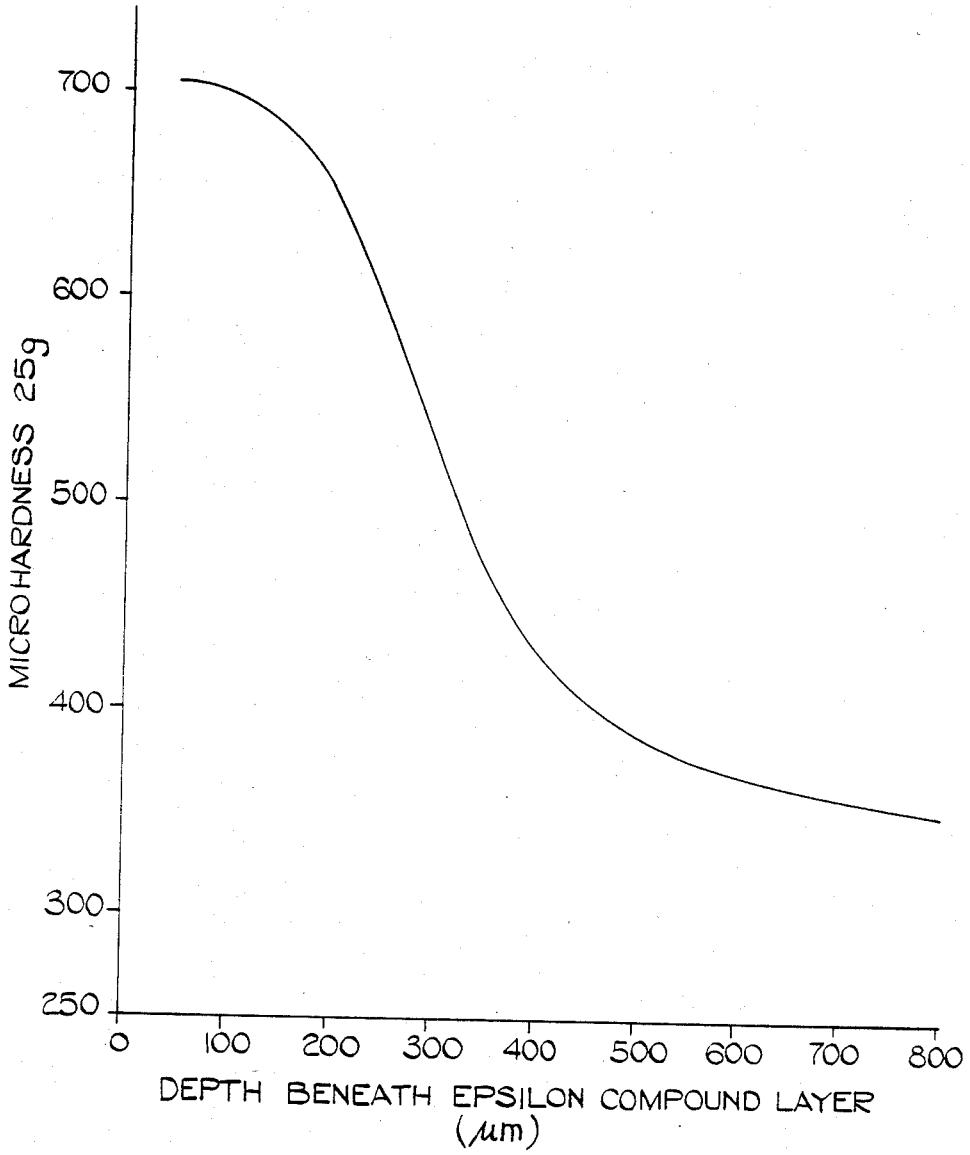
FIG. 4 illustrates the hardness profile obtained by the process of the invention as shown in example 2.

An application of the duplex treatment route is a starter gear made from BS 970 817M40 (formerly En 24) which was carburised at 850° C. for hours in endothermic gas enriched with methane to a 0.8% carbon potential (equivalent to 0.25% $CO_2$). At the end of this treatment cycle, the component was allowed to cool in the furnace hot zone under the same atmosphere to 730° C. at which point the atmosphere was adjusted to a 50 vol % ammonia, 50 vol % endothermic gas mixture. This was maintained for 15 minutes before the component was quenched in an oil/water emulsion comprising 1 part Castrol V553 to 10 parts water. A 5-second air oxidation arrest was used prior to emulsion quenching. This treatment produced a hardness profile similar to that indicated in accompanying FIG. 4 beneath an 18–20 Um thick compound layer after tempering at 300° C.

The core hardness of 350 HV is equivalent to about 70 tonf/in$^2$ (1160 MPa) core strength.

EXAMPLE 3

A damper rod manufactured from BS 970 045M10 material was nitrocarburized for 1½ hours at 610° C. in a 50 vol % ammonia, 50 vol % endothermic gas mixture. The rod was subsequently emulsion quenched in a 1:10 CASTROL V553:water mixture after exposure to air for 30 seconds.

The rod was then polished to a 4–5 microinch Ra (0.10–0.12 micrometer Ra) finish, preheated to 120° C., and immersed in an agitated alkaline solution containing 600 g/liter of a mixture of salts comprising 50 wt % sodium hydroxide, 25 wt % sodium carbonate and 25 wt % sodium nitrate controlled at a temperature of 125° C. for a period of 6 minutes.

On removal from the bath, the rod was washed in clean water and dried. After degreasing to ensure no possible oil or grease contamination of the surface, the rod was subjected to salt spray test in accordance with ASTM B117-64 and survived for 200 hours without rusting.

EXAMPLE 4

Exceptionally good support behind the compound layer can be achieved without the need to carburise as in Example 2 by suitable material selection.

For example a plain shaft made from B.S. 970 709 M40 (formerly En 19) material was austenitised in a neutral endothermic gas atmosphere at 860° C. for 30 minutes. At the end of this time the workpiece was allowed to cool in the furnace hot-zone to 720° C. at which point the atmosphere was adjusted to a 50% vol Ammonia/50% vol Endothermic gas mixture. This was maintained for 15 minutes before the shaft was quenched in an oil/water emulsion comprising 1 part castrol V553 to 10 parts water after first receiving a 5 second air-oxidation arrest.

Figure 5:
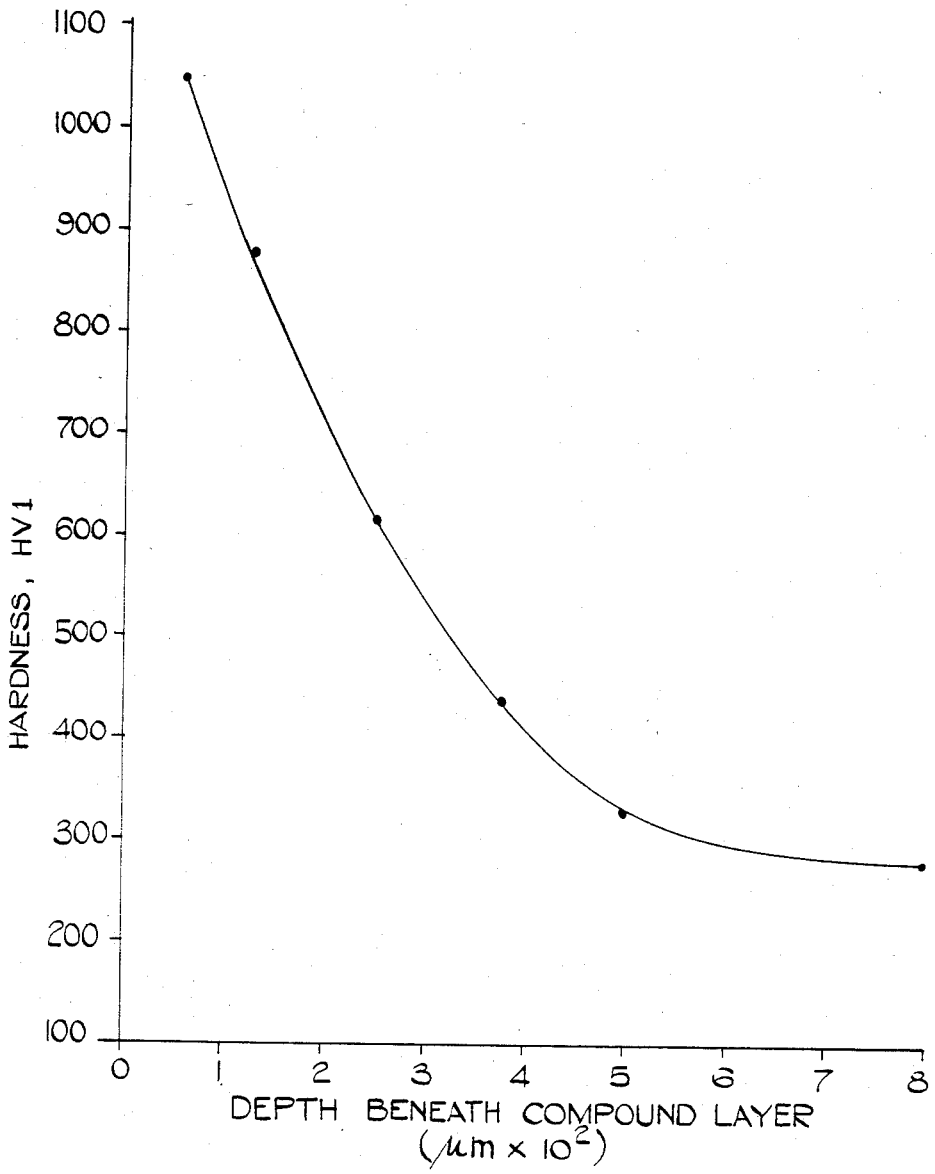
FIG. 5 illustrates the hardness profile obtained by the process as shown in example 4.

This treatment produced the hardness profile shown in FIG. 5 beneath a 25 micrometers thick compound layer.

After vapour degreasing, a tack-free solvent deposited corrosion preventative wax (e.g. Castrol V425) was applied to provide a corrosion resistant surface capable of surviving 240 hours neutral salt-spray, tested in accordance with ASTM B117-73.

We claim:

1. A method of manufacturing a corrosion-resistant steel component comprising the steps of heat treating the component in a gaseous carburizing or carbonitriding atmosphere to provide a carbon rich zone at the surface, and subsequently heat treating the component in a gaseous atmosphere to form an epsilon iron carbonitride layer on the carbon rich zone.

2. A method as claimed in claim 1, further comprising the step of quenching the component subsequent to the second heat treatment step.

3. A method as claimed in claim 2, further comprising the step of oxidizing the component prior to quenching.

4. A method as claimed in claim 3 to, wherein the subsequent heat treatment step is effected at a temperature above the pearlite to austenite transformation temperature of the steel.

5. A method of manufacturing a corrosion-resistant steel component comprising the steps of heat treating the component in a neutral atmosphere at a temperature above the pearlite-to-austenite transformation temperature of the steel and subsequently heat treating in a gaseous atmosphere at a temperature above the pearlite-to-austenite transformation temperature to produce an epsilon iron nitride of carbonitride layer on the component.

6. A method as claimed in claim 5, further comprising the step of quenching the component subsequent to the subsequent heat treating step.

7. A method as claimed in claim 6, further comprising the step of oxidising the component prior to quenching.

8. A method as claimed in claim 4, wherein the subsequent heat treatment step is effected at a temperature of up to 800° C.

9. A method as claimed in claim 5, wherein the subsequent heat treating step is effected at a temperature of up to 800° C.

10. A method as claimed in claim 2, wherein the quenching step is effected by quenching the component in an oil/water emulsion.

11. A method as claimed in claim 1 wherein the epsilon iron nitride layer or epsilon carbonitride layer has a thickness of 15 to 75 micrometers.

12. A method as claimed in claim 3, wherein the oxidation step is carried out at a temperature of greater than 550° C.

13. A method as claimed in claim 3, wherein the oxidizing heat treatment is effected by exposing the component to air for from 2 to 60 seconds.

14. A method as claimed in claim 3, wherein the oxidizing heat treatment is effected so that an oxide rich layer is formed which has a thickness of at least 0.2 micrometer.

15. A method as claimed in claim 13, wherein the oxidizing heat treatment is effected so that the oxide rich layer has a thickness of 0.2 to 1.0 micrometer.

16. A method as claimed in claim 13, wherein the oxidizing heat treatment is effected so that the oxide-rich layer has a thickness of 0.5 micrometer.

17. A method a claimed in claim 2, wherein the component is degreased after quenching.

18. A method as claimed in claim 16, wherein a waxy material is applied to the oxidised component.

19. A method as claimed in claim 17, wherein the waxy material is provided by a tack-free wax composition.

20. A method as claimed in claim 1, wherein the subsequent heat treatment in said gaseous atmosphere is carried out at a temperature of 550° C. to 720° C.

21. A method a claimed in claim 1, wherein after the subsequent heat treating step, the component is cooled, mechanically surface finished, and then oxidizing the surface finished component to provide an oxide-rich surface layer.

22. A method as claimed in claim 20, wherein the mechanical surface finishing is effected so that the surface roughness of the component does not exceed 0.2 micrometers Ra.

23. A method as claimed in claim 20, wherein the $Fe_3O_4$ surface layer is 0.5 micrometer thick.

24. A method as claimed in claim 20, wherein the surface finishing step is effected so that the component after the oxidizing step has a final surface finish of not more than 0.15 micrometers Ra.

25. A method as claimed in claim 20, wherein the oxidizing step is effected by re-heating in an oxidizing atmosphere for from 2 to 30 minutes.

26. A method as claimed in claim 20, wherein the component is quenched or fast cooled after re-heating in an oxidizing atmosphere.

27. A method as claimed in claim 1, wherein the oxidizing is effected by heat treating the surface finished component in a gaseous atmosphere at 300° to 600° C.

28. A method as claimed in claim 1, wherein the oxidizing is effected by heat treating the component in an exothermic gas mixture containing its moisture of combustion.

* * * * *